United States Patent [19]

Brewington et al.

[11] Patent Number: 4,505,573

[45] Date of Patent: Mar. 19, 1985

[54] TONER CHARGING APPARATUS CONTAINING WEAR RESISTANT COATINGS

[75] Inventors: Grace T. Brewington, Fairport; Steven B. Bolte, Rochester; Dan Hays, Fairport; William H. Wayman, Macedon, all of N.Y.

[73] Assignee: Xerox Corporation, Stamford, Conn.

[21] Appl. No.: 465,361

[22] Filed: Feb. 10, 1983

[51] Int. Cl.[3] ..... G03G 15/06

[52] U.S. Cl. ..... 355/3 DD; 118/651; 118/653; 29/132

[58] Field of Search ..... 355/3 DD, 3 CH; 118/644, 653, 656, 621, 651, 657, 658; 430/120; 29/132

[56] References Cited

U.S. PATENT DOCUMENTS

| | | | |
|---|---|---|---|
| 3,863,603 | 2/1975 | Buckley et al. | 118/637 |
| 3,959,573 | 5/1976 | Eddy et al. | 29/132 |
| 3,959,574 | 5/1976 | Seanor et al. | 29/132 |
| 4,034,709 | 7/1977 | Fraser et al. | 355/3 DD |
| 4,058,879 | 11/1977 | Lentz et al. | 29/132 |
| 4,100,884 | 7/1978 | Mochizuki et al. | 118/653 |
| 4,317,265 | 3/1982 | Chase et al. | 29/132 |
| 4,382,420 | 5/1983 | Ohnuma et al. | 118/651 |
| 4,422,749 | 12/1983 | Hoshino et al. | 118/657 X |
| 4,444,864 | 4/1984 | Takahashi | 118/658 X |

*Primary Examiner*—Richard L. Moses
*Attorney, Agent, or Firm*—E. O. Palazzo

[57] ABSTRACT

There is disclosed an apparatus for effecting the charging of insulating toner particles in a charging zone situated between a moving roller, and a toner transporting roller or belt with a coating thereover comprised of a mixture of fluoropolymers and conductive particulate particles, such as carbon black. The coating may be textured with silica particles. Useful polymers selected for the coating include fluorinated ethylene propylenepolytetrafluoro ethylene copolymers.

17 Claims, 3 Drawing Figures

TONER CHARGING APPARATUS CONTAINING WEAR RESISTANT COATINGS

The present invention is generally directed to toner charging apparatus, and more specifically, the present invention is directed to a toner charging apparatus, containing transporting members with wear resistant coatings. The apparatus of the present invention is useful in a number of imaging devices, including electrostatographic imaging devices, containing in operative relationship a means for simultaneously metering and charging non-magnetic insulating toner particles.

The development of images by various methods, including electrostatographic means is well known. In several of these systems, toner particles are deposited on an electrostatic latent image contained on an insulating surface, such as selenium, utilizing, for example, cascade development, magnetic brush development, powder cloud development, touchdown development, and the like. In view of some of the disdvantages of two component systems, there has been considerable effort directed to designing systems which utilize toner particles only, reference, for example U.S. Pat. No. 2,846,333, which disclose a single component developer composition that is comprised of toner resins, colorants and magnetic materials. Many of the single component development systems contain conductive toner particles, whereby imagewise toner deposition onto the imaging member is obtained by induction charging of the toner particles. Electrostatic transfer of conductive toner particles to plain bond paper is, however, usually inefficient as the charge on the toner particles can be reversed by induction charging from the paper during the transfer step. Accordingly, electrophotographic systems wherein conductive single component toner particles are used require a special overcoated insulating paper to achieve sufficient electrostatic toner transfer. Furthermore, in single component systems with conductive toner particles, the control of undesirable background or background suppression cannot usually be achieved with electrostatic forces, as the toner particles are inductively charged, and deposited on the imaging bearing member, which is not the situation in two component developer systems where controls of background development is accomplished by electrostatic forces acting on the triboelectrically charged toner particles, causing such particles to be directed away from image bearing members.

Recently, there has been developed an efficient, economical, simple process and apparatus for the development of latent electrostatic images with single component development systems wherein insulative, non-magnetic, or color toner particles are appropriately charged and there is obtained two component image quality utilizing a single component development apparatus. In this system, as detailed hereinafter, and as described in co-pending application U.S. Ser. No. 286,784 filed on July 27, 1981, the disclosure of which is totally incorporated herein by reference, there is selected a charging roll means which simultaneously meters and charges toner particles. A donor electrode serves to transport the toner particles, which electrode can be comprised of numerous suitable materials including for example aluminized Mylar overcoated with a polymer containing carbon black. While these materials may be satisfactory for their intended purposes, there continues to be a need for new coatings, wherein the surface topography thereof is stable, and textured to assist in the transporting of toner particles from the donor electrode to the imaging member.

Furthermore, known prior art coatings such as Krylon, although suitable for their intended purposes, are not scratch resistant over extended time periods allowing scratches to form on the toner transporting means which in turn adversely affects copy quality. Additionally, toner particles appear to permanently adhere to the surface of transporting members containing Krylon coatings, which adhesion results in undesirable high background desposits on the resulting developed images produced.

SUMMARY OF THE INVENTION

It is an object of the present invention to provide improved toner transporting systems.

In a further object of the present invention there is provided an improved donor surface for transporting toner particles in single component development systems.

In another object of the present invention there is provided toner transporting sleeves, and toner transporting belts containing improved coatings.

In yet another object of the present invention there is provided improved donor transporting sleeves containing fluoropolymer coatings.

In yet another object of the present invention there is provided improved donor transporting sleeves containing low surface energy wear resistant coatings of fluoropolymers, which sleeves are useful in single component development systems, particularly those incorporated into a system containing a metering/charging means.

These and other objects of the present invention are accomplished by the provision of a transporting means for insulating toner particles comprised of a suitable substrate and a coating thereover of a low surface energy, wear resistant material. More specifically, the present invention is directed to an insulating toner transporting system comprised of a substrate, and a coating of a fluoropolymer. The improved toner transporting means of the present invention are particularly useful in an apparatus for charging toner particles comprised in operative relationship of a means for charging insulating toner particles and a means for transporting insulating toner particles, wherein the means for charging and the means for transporting are biased to a predetermined potential.

Accordingly, in one embodiment, the present invention is directed to an apparatus for a charging insulating toner particles, which apparatus is comprised in operative relationship of a means for charging insulating toner particles and a means for transporting insulating toner particles, the means for charging and the means for transporting being biased to a predetermined potential, wherein the transporting means contains a mixture of a fluoropolymer coating, and conductive particles, such as carbon black.

In another embodiment of the present invention there is provided an apparatus for simultaneously metering and charging non-magnetic insulating toner particles comprising in operative relationship a metering/charging roll means, a triboelectrically active coating contained on the metering/charging roll means, a doctor blade means for the metering/charging roll means, toner supply reservoir means containing therein weakly charged insulating toner particles possessing about an equal number of positive toner particles and negative toner particles, a transporting toner belt means, comprised of a nickel sleeve, containing on its entire surface a coating of a fluoropolymer, a voltage source means for the metering/charging roll means, a voltage source means for the nickel sleeve means, the metering/charging roll means moving in a direction opposite to the direction of the movement of the transport donor sleeve means.

DESCRIPTION OF THE PREFERRED EMBODIMENTS

The apparatus of the present invention and various alternative embodiments will now be described with reference to the figures wherein.

Figure 1:
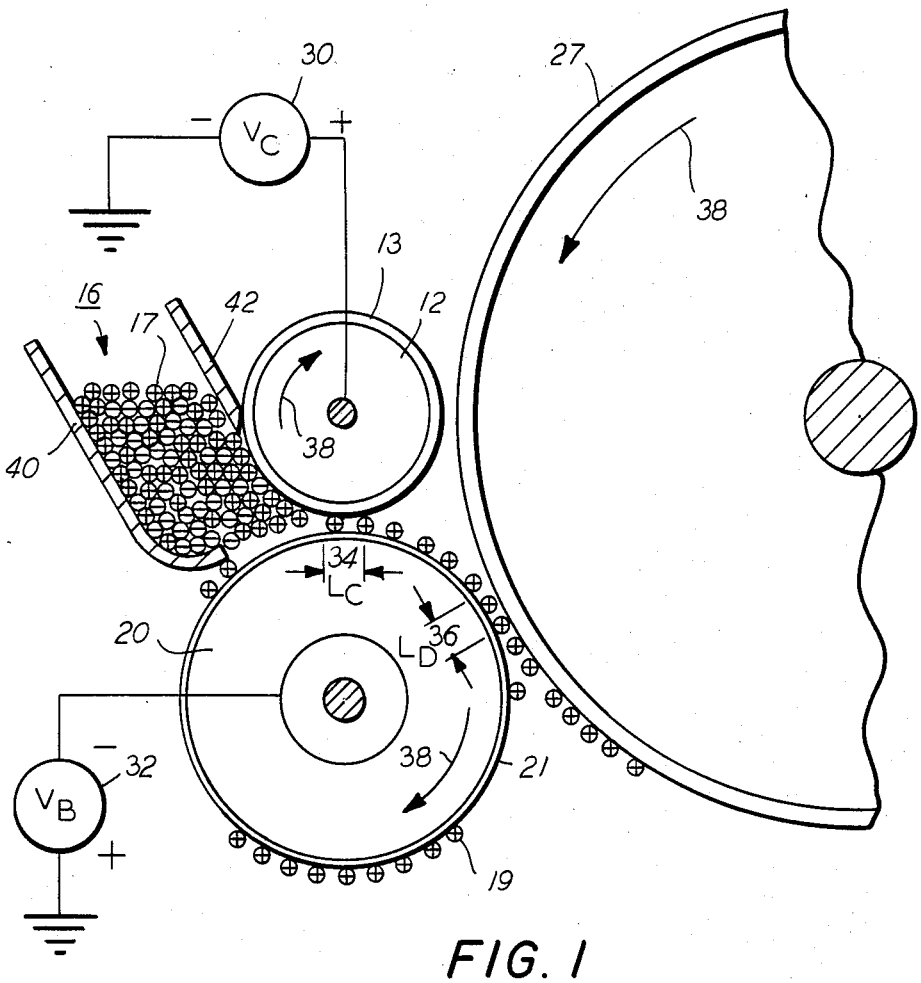
FIG. 1 is a schematic view of an embodiment of the apparatus of the present invention.

The apparatus 6 of the present invention, containing toner transporting means with fluoropolymer coatings, are useful in various imaging systems, especially those wherein there is selected a single component development apparatus containing a metering/charging roll means, as described in copending application U.S. Ser. No. 286,784, the disclosure of which is totally incorporated herein by reference. Accordingly, there is illustrated in FIG. 1 a metering charging roll means 12, containing a triboelectrically active coating thereon 13, a toner supply reservoir means 16, containing therein weakly charged insulating, non-magnetic toner particles 17, comprised of about an equal number of positive toner particles and negative toner particles, a compliant donor roll means 20, containing thereon a fluoropolymer coating 21, a rigid photoreceptor means 27, a doctor blade seal means 42, a wiper blade seal means 40, a voltage source 30 ($V_C$), a voltage source 32 ($V_B$), a charging zone 34 ($L_C$), a development zone 36 ($L_D$) with the components moving in the direction of the arrows 38.

Figure 1B:
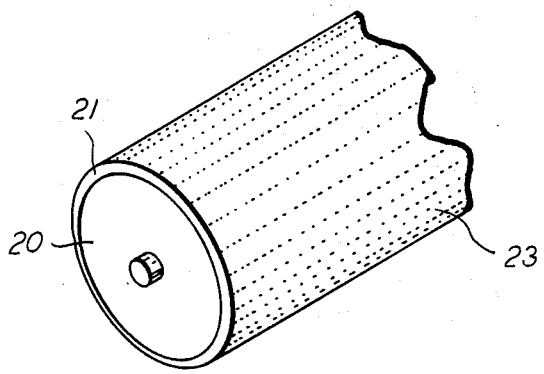
FIG. 1B illustrates a textured donor roll.

With further reference to FIG. 1, the toner particles are transported by supplying weakly charged toner particles 17 to the charging nip 34, situated between the metering charging roll means 12 and the compliant donor roll means 20, containing thereon the fluoropolymer coating 21. As a result of the movement in opposite directions, of roll means 12, and roll means 20, toner particles 17 contact coating 13 in the charging zone 34, causing these particles to acquire a positive charge thereon. The positively charged toner particles 19 are then transported by the compliant donor roll means 20, which means in a preferred embodiment is preferably textured, 23, reference FIG. 1B, with for example, particulate fillers such as silica, to a rigid imaging member 27 or flexible imaging member, not shown, where they are attracted thereto in the development zone 36. Unused toner particles are returned to the toner reservoir by roll means 20 as illustrated.

Figure 2:
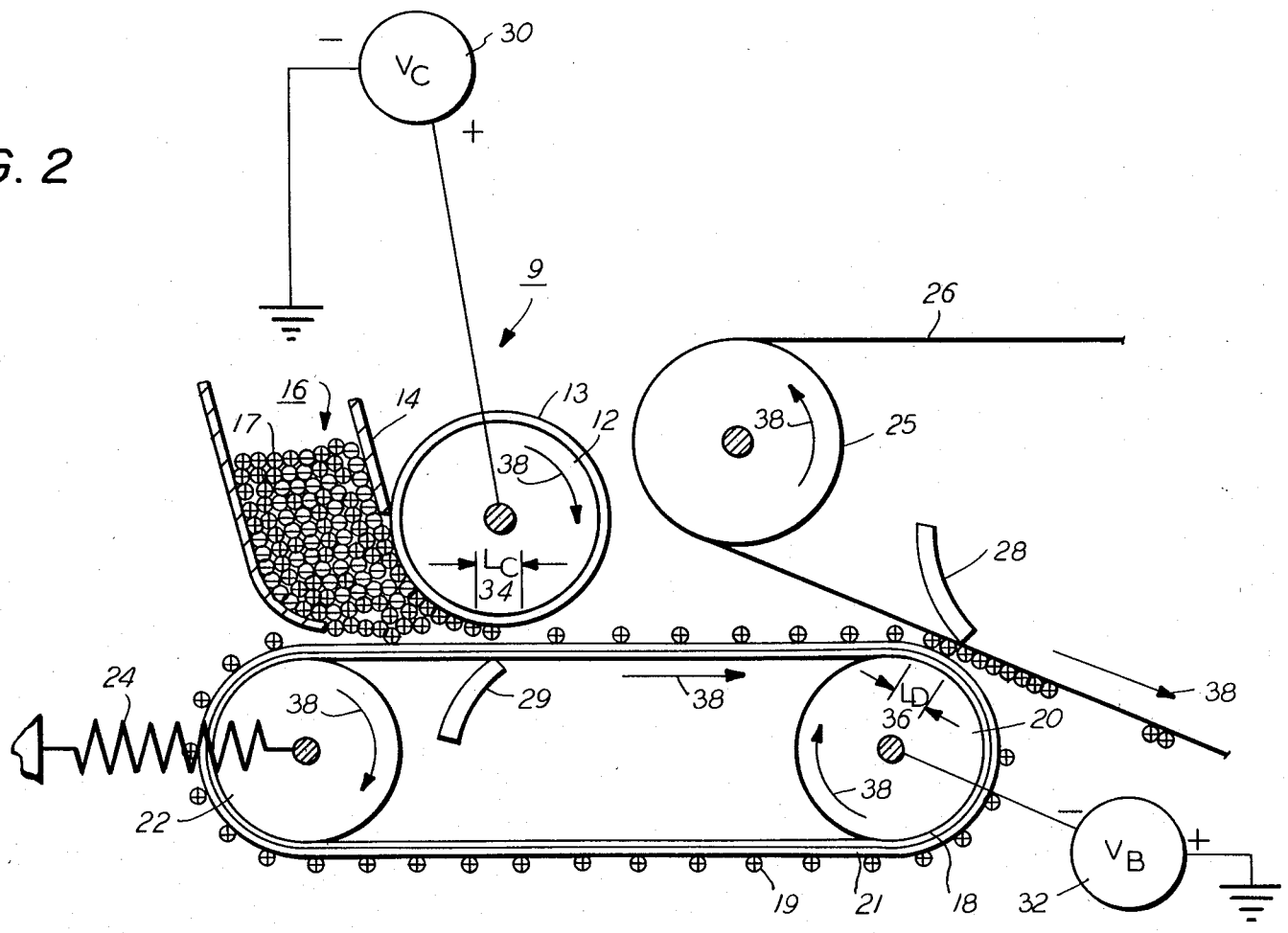
FIG. 2 is a schematic view of another embodiment of the apparatus of the present invention.

Illustrated in FIG. 2 is another embodiment of the present invention generally designated 9, comprising a metering charging roll means 12, containing a triboelectrically active coating 13 thereon, a doctor blade seal means 14, a toner supply means 16, containing toner particles 17, possessing an approximately equal number of weakly charged positive and weakly charged negative toner particles, a donor means 18, containing a fluoropolymer coating thereon 21, positively charged toner particles 19 a drive roll means 20, an idler roll means 22, a tensioning means 24, a flexible imaging member means 26, a roll means 25, a pressure blade means 28, a pressure blade means 29 for the metering/charging zone 34, a voltage source 30, a voltage source 32, a charging zone 34, a development zone 36, with the components moving in the direction as shown by the arrows 38.

In summary, with reference to FIG. 2, the weakly charged insulating toner particles 17 are deposited on the fluoropolymer coating 21 of the donor belt means 18, as a result of movement of the components, gravitational forces, and the electrostatic force from voltage source means 30, wherein the toner particles are brought into rubbing contact with the metering/charging roll means 12, in the charging zone 34, thus resulting in positively charged toner particles 19. The donor belt 18 makes a tangential contact with roll means 12, and is self-spaced therefrom by insulating toner particles with the nip pressure being supplied by compliant blade means 29 positioned on the backside of the belt 18. Positively charged toner particles 19 are then transported on the donor belt surface coating 21, until contacting the flexible imaging member 26 in the development zone 36 $L_D$, wherein the particles are then transferred to the imaging member which has been charged negatively. Pressure blade 28 provides sufficient force to ensure contact of the positively charged toner particles, with the imaging member 26 for the distance 36. Unused positively charged toner particles are as shown returned to the toner reservoir 16 for reuse in the system.

The core of metering/charging roll means 12 can be solid or hollow, and can be comprised of numerous known suitable materials including, for example, aluminum, steel, iron, polymeric materials, and the like, providing they are of sufficient strength to be operable in the system. Generally, the core which is preferably aluminum is of a radius of from about 0.25 inches to about 2 inches, and preferably is from about 0.5 inches to about 1 inch. Idler roll means 22 can be comprised of the same materials as roll 12, this roll ranging in diameter of from about 0.25 inches to about 1 inch.

The triboelectric coating 13 contained on the metering/charging roll means 12, can be selected from numerous materials known in the art, including many of the same materials used for coating carrier particles. This coating is selected according to the charge that is desired to be imparted to the toner particles. Thus, if it is desired to impart a positive charge to the toner particles, a coating capable of acquiring negative charges thereon is selected. These coatings, including various electronegative materials such as polymers, including copolymers of trifluorochloroethylene and vinylchloride commercially available as FPC 461. Examples of other electronegative materials that can be selected include highly halogenated polymers, such as polyvinylidene fluoride, polytetrafluoroethylenes, perfluoroalkoxylatedethylenes, fluorinated ethylenepropylene polytetrafluoroethylene copolymers, polyvinylchlorides, and the like. In those situations where it is desired to impart a negative charge to the insulating toner particles, a coating capable of acquiring a positive charge thereon is selected, including various electropositive materials such as polyvinylpyridines, terpolymers of methacrylates, such as polystyrene/n-butylmethacrylate silane terpolymers, polycaprolactum, and the like. Additionally, there can be selected as coatings 13, materials analogous to thermoplastic toner resin as described hereinafter, containing charge control agents for the purpose of imparting a positive or negative charge to the toner particles. Various suitable charge control agents can be used including alkylpyridinium halides, such as cetylpyridinium chloride, quaternary ammonium compounds, or sulfate compounds, hydrozonium compounds, and the like. Generally, the charge enhancing additives are present in an amount of from about 0.1 percent to about 10 percent.

The thickness of coating 13 is dependent on many factors including economical considerations, however, this coating is generally of a thickness of from about 2 micrometers to about 125 micrometers, and preferably is of a thickness of from about 2 micrometers to about 75 micrometers.

The compliant donor roll means 20, generally consists of an elastic core, such as a polyurethane foam or silicone rubber, covered with a seamless, flexible and conductive sleeve such as electroformed nickel, or an extruded polymer coated with a polymer containing carbon black. The conductive sleeve such as electroformed nickel can also be overcoated with materials described herein with reference to the donor means 18.

Drive roll means 20 and idler roll means 22 can be comprised of conductive rubber materials, while the transporting donor means 18, reference FIG. 2, can be comprised of numerous suitable materials including, for example, aluminized Mylar, overcoated with a fluoropolymer 21, a seamless electroformed nickel belt, overcoated with a fluoropolymer, a seamless extruded polymer sleeve overcoated with a polymer containing a conductive additive such as carbon black, which sleeve is overcoated with a fluoropolymer, or a bare electroformed nickel sleeve, containing thereover a fluoropolymer coating processed in such a manner so as to impart a texture to the surface thereof.

Illustrative examples of the image bearing member means 26 and 27, include inorganic and organic photoreceptor materials such as amorphous selenium, selenium alloys, including alloys of selenium-tellurium, selenium arsenic, selenium antimony, selenium-tellurium-arsenic, cadmium sulfide, zinc oxide, polyvinylcarbazole, layered organic photoreceptors, such as those containing as an injecting contact, carbon dispersed in a polymer, overcoated with a photogenerating layer, which in turn is overcoated with a charge transport layer, and an overcoating of an insulating organic resin, such as those members described in U.S. Pat. No. 4,251,612. Also included within the scope of the present invention are imaging members comprised of a substrate, a transport layer, such as a diamine dispersed in a polymer, and a generating layer such as trigonal selenium, as described in U.S. Pat. No. 4,265,990, the disclosure of which is totally incorporated herein by reference.

Other organic photoreceptor materials include 4-dimethylaminobenzylidene, benzhydrazine; 2-benzylidene-amino-carbazole, 4-dimethylnitro-benzylidene)-p-bromo-aniline; 2,4-diphenyl quinazoline; 1,2,4-triazine; 1,5-diphenyl-3-methyl pyrazoline 2-4('-dimethyl-amino phenyl)benzoxazole; 3-amino-carbazole; polyvinylcarbazoletrinitrofluorenone charge transfer complexes; phthalocyanines and mixtures thereof, and the like. Generally, positively charged toner compositions are selected when the imaging member is charged negatively as is the situation with most organic photoreceptors, while negatively charged toner particles are selected when the imaging member is charged positively, as is the situation with most inorganic photoreceptors, such as selenium.

Illustrative examples of coatings 21, that can be selected for the apparatus of the present invention include fluoropolymers, perfluoroalkoxy polymers, and polyethersulfones, commercially available from ICI Americas, Inc. with the fluoropolymers, which are commercially available from E. I. duPont Inc. being preferred. In one embodiment of the present invention, fluoropolymer coatings 21, with the following properties and characteristics are selected:

1. A volume resistivity in the range of $10^6$ to $10^{10}$ ohm·cm.
2. A residual surface potential of less than about 5 volts.
3. A surface texture with peak to peak variations of 0.5 micrometers to 10 micrometers, and a spatial variation ranging from 5 micrometers to 100 micrometers.
4. A sufficient non-tackiness allowing the toner particles to be released from the transporting member surface in the development zone. By non-tackiness is meant that uncharged toner particles can be easily removed from the surface by wiping, for example, with a soft cloth or with an air jet.
5. A triboelectric interaction with the toner particles in order to allow the toner particles to acquire the desired charge polarity.
6. Those with a surface energy as low as possible, enabling them to reduce the permanent adhesion of the toner particles to the transporting toner means. Generally, the surface energy of the fluoropolymer coatings should be lower than the surface energy of the toner particles.

Particularly preferred coatings 21 selected for use in the present invention include the fluoropolymer Teflon-S, 954-207 commercially available from E. I. duPont deNemours, Inc, which has included therein 0.25 percent by weight to 0.50 percent by weight of Vulcan carbon black, or the fluoropolymer Teflon-S 954-203, commercially available from E. I. duPont deNemours, Inc, which fluoropolymer contains therein 3 percent by weight of Vulcan carbon black and 10 percent by weight of a silica filler, which functions as a texturing agent.

Particularly useful as the coating 21 for the apparatus of the present invention is a material comprised of a mixture of 10 percent by weight of silica and 90 percent by weight of a polytetrafluoroethylene, polyethersulfone, carbon black mixture, commercially available from ICI Americas, Inc, as Ultralon OC 409, and a fluorinated ethylene propylene and polytetrafluoroethylene copolymer, polyimide, carbon black, mixture available from E. I. duPont deNemours, Inc, which has incorporated therein about 10 percent by weight of silica.

Generally, the carbon black which is contained in the fluoropolymer, or added thereto, is present in an amount ranging from about 0.125 percent by weight to about 10 percent by weight, this carbon black being present primarily for the purpose of increasing the conductivity of the surface of the toner transporting means to about $10^6$ to $10^{10}$ ohm·cm. Moreover, silica and other particulate fillers can also be incorporated into the fluoropolymers, in an amount of from about 3 percent by weight to about 10 percent by weight, for the purpose of creating the desired surface texture. Examples of preferred fillers include Syloid® silicas (Davison Chemical Division of W. R. Grace & Company); amorphous silicas (Illinois Minerals Company); air floated amorphous silicas (Illinois Minerals Company); calcined aluminum silicate (Engelhard Minerals & Chemicals Corporation); calcium metasilicates (NYCO); particulate metallic stearates (Witco Chemical Corporation, Mallinckrodt, Inc.); and particulate polymeric resins.

These particulate fillers, which are added to the transporting means appear as protuberances in the coating 21, which protuberances can be characterized in terms of height and frequency by a surface profilometer.

The coating 21 is present on the entire outer surface of the transporting toner means, and generally is present in a thickness of from about 2 micrometers to about 125 micrometers, and preferably is present in a thickness of from about 10 micrometers to about 50 micrometers. Coating thicknesses outside the ranges specified may be useful providing the objectives of the present invention are accomplished.

The coating can be applied by numerous known methods including, for example, spray coating, dip coating, Myer rod, draw bar, electrostatic deposition, and the like.

The primary purpose of the coating of the present invention is for wear resistance, that is, to prevent the transporting donor means from deteriorating over extended usage. Also, these coatings function so as to resist contamination from toner particles permanently adhering to the surface thereof over extended time periods. This toner contamination has a tendency to mask the coating surface texture causing high background areas in the final developed images. However, the fluoropolymer coatings contained on the transporting toner means enable the surface texture to be maintained.

Illustrative examples of toner resin materials include for example, polyamides, epoxies, polyurethanes, vinyl resins and polymeric esterification products of a dicarboxylic acid and a diol comprising a diphenol. Any suitable vinyl resin may be employed in the toners of the present system, including homopolymers or copolymers of two or more vinyl monomers. Typical of such vinyl monomeric units include: styrene, p-chlorostyrene vinyl naphthalene, ethylenically unsaturated mono-olefins such as ethylene, propylene, butylene, isobutylene and the like; vinyl esters such as vinyl chloride, vinyl bromide, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate, butyl methacrylate, and the like, acrylonitrile methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinyildene halides such as vinylidene chloride, vinylidene chlorofluoride and the like; and N-vinyl indole, N-vinyl pyrrolidene and the like; and mixtures thereof.

Also esterification products of a dicarboxylic acid and a diol comprising a diphenol may be used as a preferred resin material for the toner composition of the present invention. These materials are illustrated in U.S. Pat. No. 3,655,374, totally incorporated herein by reference, the diphenol reactant being for the formula as shown in Column 4, beginning at line 5 of this patent, and the dicarboxylic acid being of the formula as shown in Column 6 of the above patent. The resin is present in an amount so that the total of all ingredients used in the toner total about 100 percent, thus when 5 percent by weight of a charge enhancing additive is present and 10 percent by weight of a pigment such as carbon black is present, about 85 percent by weight of resin material is used.

The toner resin particles can vary in diameter, but generally range from about 5 micrometers to about 30 micrometers in diameter, and preferably from about 10 micrometers to about 20 micrometers.

Various suitable pigments or dyes may be selected as the colorant for the toner particles, such materials being well known, and including for example, carbon black, nigrosine dye, aniline blue, calco oil blue, chrome yellow, ultramarine blue, duPont oil red, methylene blue chloride, phthalocyanine blue and mixtures thereof. The pigment or dye should be present in sufficint quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Inc. Preferably, the pigment is employed in amounts of from about 3 percent to about 20 percent by weight, based on the total weight of the toner, however, if the colorant employed is a dye, substantially smaller quantities of the color may be used.

Also, there can be incorporated in the toner composition various enhancing additives, primarily for the purpose of imparting a positive charge to the toner resin. Examples of such additives include quaternary ammonium compounds and alkyl pyridinium halides, such as cetyl pyridinium chloride, cetyl pyridinium tosylate, and the like.

The following examples are being supplied to further define certain embodiments of the present invention, it being noted that these examples are intended to be illustrative only and are not intended to limit the scope of the present invention. Parts and percentages are by weight unless otherwise indicated.

EXAMPLE I

There was prepared a donor transporting means by coating on a nickel sleeve, a mixture of polytetrafluoroethylene, polyethersulfone, carbon black, which mixture is available from ICI Americas, Inc, as Ultralon OC 409, and silica in the following manner:

A slurry of a silica texturing agent, available from Davison Chemical Company, a division of W. R. Grace Co., as Syloid®169 silica, was prepared by mixing about 2.7 grams of this material and 10 milliliters of ICI solvent S400 in a Waring blender for 1–2 minutes. This slurry was then slowly poured into 100 grams of the Ultralon OC 409 mixture, followed by stirring. Subsequently, the slurry was mixed on a paint shaker for about 15 minutes. The resulting mixture was then spray coated on a nickel sleeve to a thickness of 20 micrometers, followed by the curing of the resulting device in air containing 95 percent nitrogen and 5 percent by weight hydrogen, which curing was effected at a temperature of 340° C. for 15 minutes. The resulting device was then allowed to cool to a temperature of below 200° C., removed from the oven and allowed to cool to room temperature. The resulting nickel sleeve coated in a thickness of 20 micrometers of a polytetrafluoroethylene, polyethersulfone, carbon black, silica mixture, was then incorporated as the transporting donor belt 18 in the device illustrated in FIG. 2, and no surface contamination or wear of the belt was visually observed after two hours of bench running.

Under the same process conditions, there was then selected as the toner transporting belt 18 a nickel sleeve containing a coating of Krylon 1602/1316, 20 micrometers in thickness, and surface contamination and wear was visually observed after two hours of bench running.

EXAMPLE II

There was prepared a toner transporting means by coating a nickel sleeve with a fluorinated ethylene propylene polytetrafluoroethylene copolymer, polyimide, carbon black, silica mixture, commercially available from E. I. duPont de Nemours & Co. Inc., as Teflon-S 954-207 in the following manner:

A slurry of Vulcan carbon black, was prepared by mixing about 0.09 grams of carbon black and 10 milliliters of solvent, commercially available from E. I. duPont de Nemours & Co. Inc., as solvent mixture T8595, in a Waring blender for 1–2 minutes. This slurry was then slowly poured into 100 grams of Teflon-S 954-207, followed by stirring and mixing on a paint shaker for 15 minutes. The resulting mixture was then spray coated on a nickel sleeve to a thickness of 25 micrometers, followed by curing in air containing 5 percent by weight of hydrogen, and 95 percent by weight of nitrogen, at a temperature of about 300° C. for 20 minutes. The resulting device was then cooled to below 200° C. and finally allowed to cool to room temperature.

The resulting device which was comprised of a nickel coated sleeve with Teflon-S 954-207, in a thickness of 25 micrometers, was then selected as the toner transporting means 18, and incorporated into the device illustrated in FIG. 2. No surface contamination or wear of the transporting means was visually observed after fifteen hours of bench running and no toner throughput resulted, with a toner composition containing 93 percent by weight of a styrene n-butadiene copolymer, containing 89 percent by weight of styrene, 11 percent by weight of butadiene, 6 percent by weight of Regal 330 carbon black, and 1 percent by weight of the charge enhancing additive cetylpyridinium tosylate.

The toner transporting coating of this example was also applied to a nickel sleeve, and this roll selected as the compliant roll 20, and incorporated into the device of FIG. 1. Stable performance of the roll was exhibited in that no wear of the roll was observed, and no degradation in image print quality was observed after 50,000 imaging cycles, with a toner containing 92 percent by weight of a styrene n-butylmethacrylate copolymer resin, 58 percent by weight of styrene, and 42 percent by weight of n-butylmethacrylate, 6 percent by weight of Regal 330 carbon black, and 2 percent by weight of the charge enhancing additive stearyl phenylethyl ammonium para-toluene sulfonate.

Subsequently, the roll was again tested with the same toner composition and stable performance was observed for over 100,000 imaging cycles.

The roll was also tested in the same manner with a toner comprised of 94 percent by weight of a styrene terpolymer, containing about 58 percent by weight of styrene, 21 percent by weight of methylmethacrylate, and 20 percent by weight of 2-ethylhexyl methacrylate, and 5 percent by weight of carbon black, and as the charge enhancing additive, slightly less than 2 percent by weight of cyastat LS commercially available, and substantially similar results were observed for 80,000 imaging cycles.

EXAMPLE III

The procedure of Example II was repeated with the exception that the coating for the nickel sleeve was prepared by adding silica filler, as a texturing agent, to Teflon-S 954-203, a polymer available from E. I. duPont deNemours, Inc, containing fluorinated ethylene propylene polytetrafluoroethylene copolymer, polyimide, as a binder, and carbon black. This was accomplished by first preparing a slurry of carbon black and silica filler, by mixing about 1.05 grams of carbon black with 3.5 grams of Syloid 620 silica in 20 milliliters of duPont solvent T8595 in a Waring blender for 1–2 minutes. This slurry was then poured into 100 grams of Teflon S 954-203, and after stirring and mixing in accordance with the procedure of Example II, the mixture was spray coated on a nickel sleeve to a thickness of 25 micrometers. The resulting textured toner transporting device containing the overcoated nickel sleeve, was then tested in the device of FIG. 1, and substantially similar desirable results were obtained, as in Example I.

Other modifications of the present invention will occur to those skilled in the art based upon a reading of the present disclosure. These are intended to be included within the scope of this invention.

We claim:

1. An apparatus for charging insulating toner particles comprised in operative relationship of a charging zone situated between a moving means for charging the toner particles and a moving means for transporting the toner particles, said means for charging and said means for transporting biased to a predetermined potential, wherein the transporting means contains as a coating a mixture of a fluoropolymer and conductive particulate particles, and wherein substantially uncharged toner particles are introduced into the charging zone.

2. An apparatus in accordance with claim 1 wherein the coating mixture is present on the entire outer surface of the transporting means, in a thickness of from about 2 micrometers to about 125 micrometers.

3. An apparatus in accordance with claim 1 wherein the fluoropolymer is polytetrafluoroethylene, or a fluorinated ethylene propylenepolytetrafluoroethylene copolymer.

4. An apparatus in accordance with claim 1 wherein the conductive particles are carbon black.

5. An apparatus in accordance with claim 1 wherein the coating is textured.

6. An apparatus in accordance with claim 5 wherein the texturing agent is silica.

7. An apparatus in accordance with claim 1 wherein the coating is deposited on a metallic substrate.

8. An apparatus in accordance with claim 7 wherein the metallic substrate is nickel deposited on an aluminum sleeve.

9. An apparatus in accordance with claim 1 wherein the coating is deposited on a polymeric composition.

10. An apparatus in accordance with claim 1 wherein the means for imaging comprised of an inorganic or organic photoconductive composition.

11. An apparatus in accordance with claim 10 wherein the inorganic composition is selenium and the organic composition is comprised of a substrate, a charge generating layer and a charge transport layer.

12. An apparatus for simultaneously metering and charging nonmagnetic insulating toner particles comprising in operative relationship a metering/charging roll means, a triboelectrically active coating contained on the metering/charging roll means, a doctor blade means for the metering/charging roll means, a toner supply reservoir means containing therein weakly charged insulating toner particles comprised of about an equal number of positive toner particles and negative toner particles, a transport toner donor means, comprised of a nickel sleeve, containing as a coating a mixture of a fluoropolymer, and conductive particulate particles, said coating ranging in a thickness of from about 2 micrometers to about 125 micrometers, a voltage source means for the metering/charging means, a voltage source means for the nickel sleeve means, the metering/charging roll means moving in a direction opposite to the direction of movement of the transport donor sleeve means, and wherein substantially uncharged toner particles are introduced into charging zone situated between the metering/charging roll means and the transport toner donor means.

13. An apparatus in accordance with claim 12 wherein the fluoropolymer is polytetrafluoroethylene, or fluorinated ethylene propylenepolytetrafluoroethylene copolymer, and the conductive particulate particles are carbon black.

14. An apparatus in accordance with claim 12 wherein the coating contains a texturing composition.

15. A xerographic imaging apparatus comprised of a charging means for charging an imaging surface, a development means, a transfer means, and a fixing means, wherein said development means contains a charging zone situated between a charging toner means and a transporting means, and wherein the transporting means is coated with a wear resistant mixture of a fluoropolymer and conductive particulate particles.

16. An apparatus in accordance with claim 15 wherein the fluoropolymer is polytetrafluoroethylene, or fluorinated ethylenepropylenepolytetrafluoroethylene copolymer, and the conductive particles are carbon black.

17. An apparatus in accordance with claim 15 wherein the coating is textured.

* * * * *